US008826922B1

(12) United States Patent
Lewis

(10) Patent No.: US 8,826,922 B1
(45) Date of Patent: Sep. 9, 2014

(54) GUIDED HAIR-CUTTING DEVICE

(71) Applicant: Joshua I. Lewis, Scotland Neck, NC (US)

(72) Inventor: Joshua I. Lewis, Scotland Neck, NC (US)

( * ) Notice: Subject to any disclaimer, the term of this patent is extended or adjusted under 35 U.S.C. 154(b) by 0 days.

(21) Appl. No.: 13/866,545

(22) Filed: Apr. 19, 2013

(51) Int. Cl.

| | |
|---|---|
| ***A45D 24/36*** | (2006.01) |
| ***A45D 24/34*** | (2006.01) |
| ***B26B 21/40*** | (2006.01) |
| ***B26B 19/00*** | (2006.01) |
| ***A61B 1/00*** | (2006.01) |
| ***A61B 5/103*** | (2006.01) |
| ***A61B 5/117*** | (2006.01) |
| ***A45D 27/42*** | (2006.01) |

(52) U.S. Cl.
CPC ..... *A45D 24/36* (2013.01); *A45D 27/42* (2013.01)
USPC ..... 132/214; 132/213; 30/537; 30/201; 33/512

(58) Field of Classification Search
CPC ..... A45D 24/36; A45D 24/38; A45D 24/10; A45D 27/42; B26B 19/3813; B26B 19/20; B26B 21/42; A61B 5/107; A61B 5/1072
USPC ..... 132/214, 212, 213, 213.1, 215, 129, 132/130, 132, 135, 319, 200, 144, 148; 30/253, 254, 286, 30, 34.05, 537, 233, 30/195, 198, 199, 200, 201; 33/458, 459, 33/460, 461, 462, 464, 465, 483–485, 511, 33/512; 434/94; D28/44.2; 83/200, 373, 83/441, 442, 443, 447, 448, 449, 453, 454, 83/467.1, 468.93; 119/600, 601, 610, 611, 119/613, 617, 618, 619; D10/71, 74; D8/6
See application file for complete search history.

(56) References Cited

U.S. PATENT DOCUMENTS

| | | | | | |
|---|---|---|---|---|---|
| 1,053,757 | A | * | 2/1913 | Tucker | 33/460 |
| 1,091,372 | A | * | 3/1914 | Mickelson | 132/214 |
| 1,355,038 | A | * | 10/1920 | Ford | 132/214 |
| 1,378,745 | A | * | 5/1921 | Wavrin | 33/460 |
| 1,381,381 | A | * | 6/1921 | Williams | 132/134 |
| 1,385,722 | A | | 7/1921 | Sessoms | |
| 1,401,070 | A | * | 12/1921 | Gregory | 132/144 |
| 1,442,359 | A | * | 1/1923 | Posnick | 132/214 |
| 1,457,257 | A | * | 5/1923 | McLaughlin | 132/144 |
| 1,471,768 | A | * | 10/1923 | Wright | 132/214 |
| 1,494,488 | A | * | 5/1924 | Jaster | 132/214 |
| 1,537,783 | A | * | 5/1925 | Olson | 132/214 |
| 1,585,088 | A | * | 5/1926 | Delmon | 132/214 |
| 1,589,037 | A | * | 6/1926 | Aasen et al. | 132/214 |
| 1,639,804 | A | * | 8/1927 | Lewis | 132/144 |

(Continued)

*Primary Examiner* — Vanitha Elgart

(57) ABSTRACT

A guided hair-cutting device guides a cutting implement along a user's hairline to evenly cut the front, back, and sides of the user's hair. The device includes a pair of side guards and a front guard coupled to and extending between the side guards. The side guards extend downwardly away from the front guard. Each of the guards comprises a pair of panels. A slot is positioned in each of the guards. Each of the slots has a plurality of teeth positioned therein such that each of the slots is configured to receive teeth from a hair clipper. The panels of each of the guards are slidable such that hair positioned on an inner side of the associated one of the guards is cut when an associated one of the panels is moved along a length of the guard and the hair is engaged by the teeth of the hair clipper.

11 Claims, 3 Drawing Sheets

(56) References Cited

U.S. PATENT DOCUMENTS

| | | | | | |
|---|---|---|---|---|---|
| 2,244,068 | A | * | 6/1941 | Kay | 132/123 |
| 2,510,943 | A | * | 6/1950 | Arnold | 132/148 |
| 2,542,450 | A | * | 2/1951 | Altman | 132/213 |
| 2,562,421 | A | * | 7/1951 | Hendra | 132/148 |
| 2,686,973 | A | * | 8/1954 | Christianson et al. | 33/461 |
| 2,698,018 | A | * | 12/1954 | Post | 132/213 |
| 2,765,797 | A | * | 10/1956 | Potente | 132/213 |
| 2,786,477 | A | * | 3/1957 | Cohen | 132/214 |
| 2,936,767 | A | | 5/1960 | McDonough | |
| 3,055,376 | A | * | 9/1962 | Walls | 132/213 |
| 3,180,341 | A | * | 4/1965 | Dumont | 132/213 |
| D210,181 | S | | 2/1968 | Solomon | |
| 3,407,823 | A | | 10/1968 | Selvaggio | |
| 3,709,234 | A | * | 1/1973 | Seerahn | 132/214 |
| 4,137,925 | A | * | 2/1979 | Castillo | 132/214 |
| 5,213,116 | A | * | 5/1993 | Stein | 132/213.1 |
| 5,865,192 | A | | 2/1999 | Sealy | |
| 5,875,790 | A | * | 3/1999 | Morrison | 132/213.1 |
| 6,510,616 | B1 | * | 1/2003 | Sparkman | 33/460 |
| 7,559,331 | B2 | | 7/2009 | Ward | |
| 8,474,466 | B2 | * | 7/2013 | Lakin | 132/213 |
| 2004/0074511 | A1 | * | 4/2004 | Sussan | 132/214 |
| 2005/0217687 | A1 | | 10/2005 | Flanick | |
| 2007/0261709 | A1 | | 11/2007 | Bakus | |
| 2012/0073594 | A1 | * | 3/2012 | Zhang | 132/213.1 |
| 2013/0000657 | A1 | * | 1/2013 | Rofe | 132/200 |

* cited by examiner

GUIDED HAIR-CUTTING DEVICE

BACKGROUND OF THE DISCLOSURE

Field of the Disclosure

The disclosure relates to hair-cutting devices and more particularly pertains to a new hair-cutting device for guiding a cutting implement along a user's hairline to evenly cut the front, back, and sides of the user's hair.

SUMMARY OF THE DISCLOSURE

An embodiment of the disclosure meets the needs presented above by generally comprising a pair of side guards and a front guard coupled to and extending between the side guards. The side guards extend downwardly away from the front guard. Each of the guards comprises a pair of panels. A slot is positioned in each of the guards. Each of the slots has a plurality of teeth positioned therein such that each of the slots is configured to receive teeth from a hair clipper. The panels of each of the guards are slidable such that hair positioned on an inner side of the associated one of the guards is cut when an associated one of the panels is moved along a length of the guard and the hair is engaged by the teeth of the hair clipper.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
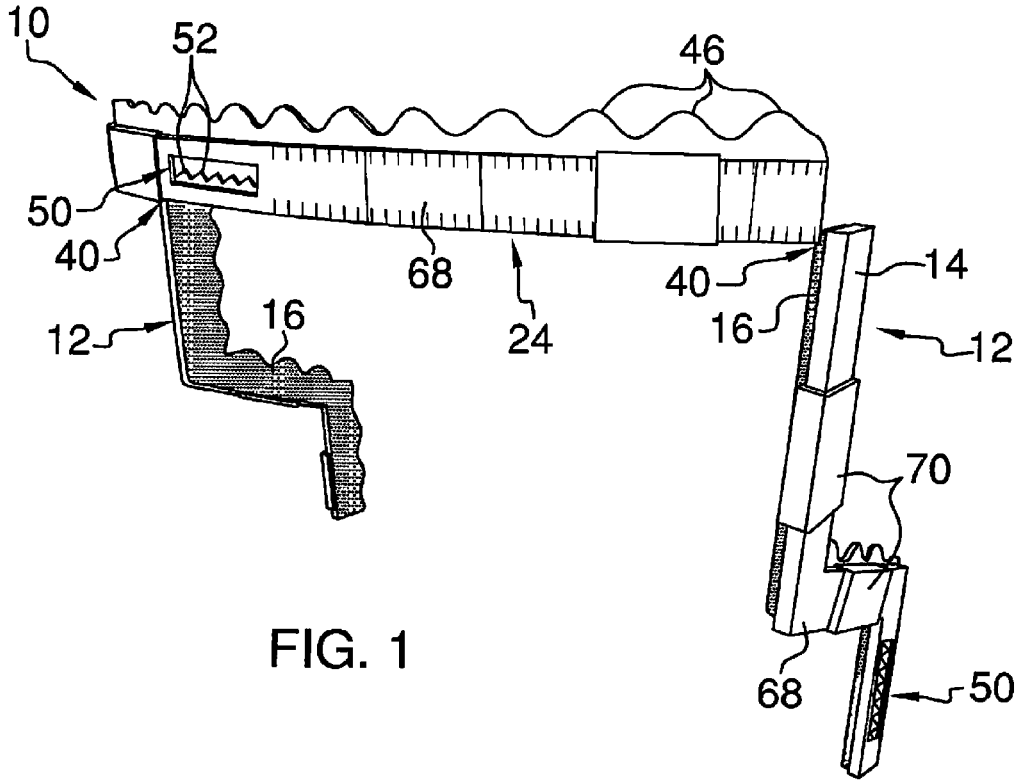
FIG. 1 is a top front side perspective view of a guided hair-cutting device according to an embodiment of the disclosure.
Figure 2:
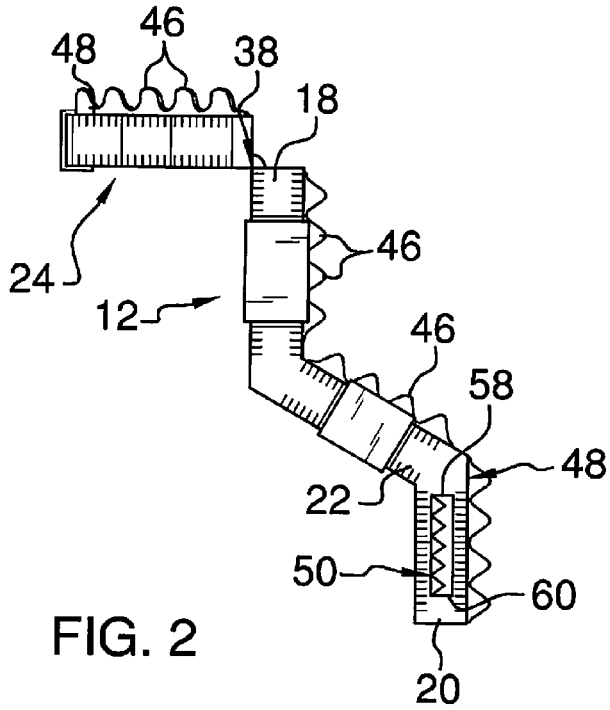
FIG. 2 is a side view of an embodiment of the disclosure.
Figure 3:
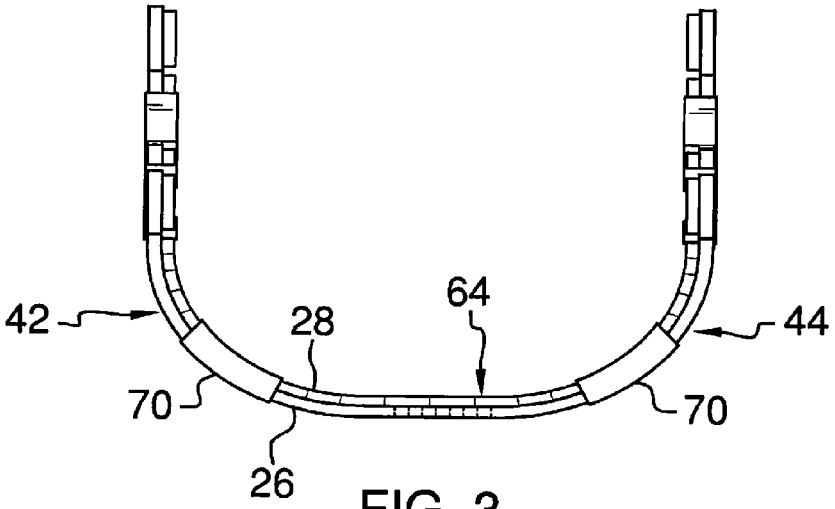
FIG. 3 is a top view of an embodiment of the disclosure.
Figure 4:
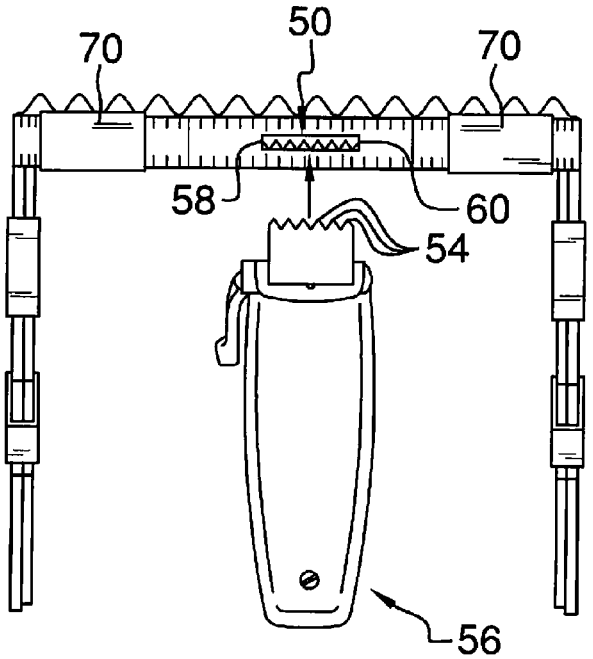
FIG. 4 is a front view of an embodiment of the disclosure.
Figure 5:
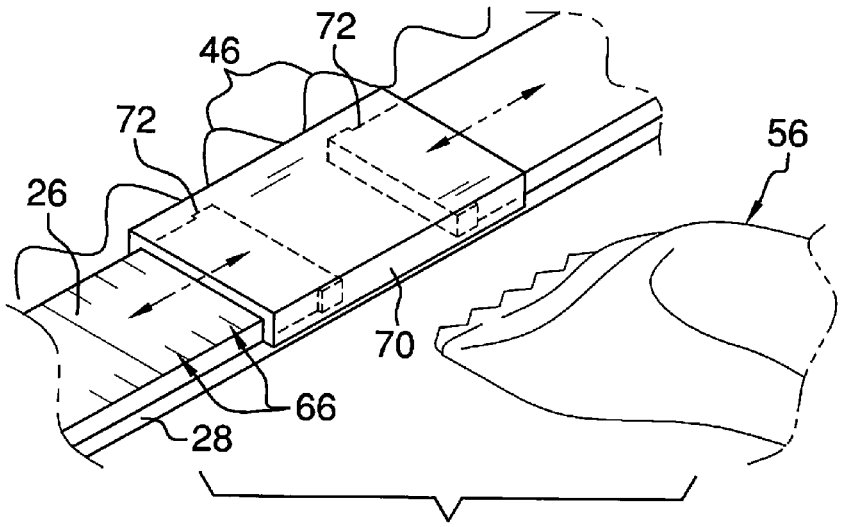
FIG. 5 is a detailed view of a front guard of an embodiment of the disclosure.
Figure 6:
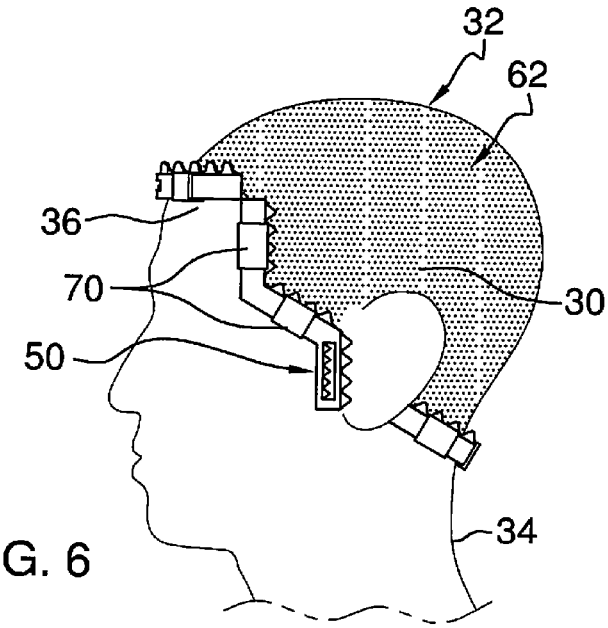
FIG. 6 is a side view of an embodiment of the disclosure in use.

With reference now to the drawings, and in particular to FIGS. 1 through 6 thereof, a new hair-cutting device embodying the principles and concepts of an embodiment of the disclosure and generally designated by the reference numeral 10 will be described.

As best illustrated in FIGS. 1 through 6, the guided hair-cutting device 10 generally comprises a pair of side guards 12. Each of the side guards 12 comprises an outer panel 14 abutting an inner panel 16. Each of the side guards 12 is spaced and preferably parallel. The side guards 12 each comprise a top portion 18, a bottom portion 20, and a medial portion 22 extending between the top 18 and bottom portions 20. The top portion 18 is spaced and preferably parallel relative to the bottom portion 20. The medial portion 22 is offset from the top 18 and bottom portions 20.

A front guard 24 is coupled to and extends between the side guards 12. The front guard 24 comprises an outside panel 26 abutting an inside panel 28. The side guards 12 extend downwardly away from the front guard 24 wherein the side guards 12 are configured for positioning against sides 30 of a head 32 of a wearer and the front guard 24 is configured for positioning against a back of a neck 34 or a forehead 36 of the wearer. Thus, it should be understood that the guards 12, 24 are placed along a wearer's hairline so as to create a well-defined edge for cutting the wearer's hair 62. The front guard 24 is preferably arcuate to fit against a wearer's hairline. An upper inner edge 38 of the top portion 18 of each of the side guards 12 is coupled to a bottom outside edge 40 of a respective one of a first side 42 and a second side 44 of the front guard 24. The front guard 24 is preferably positioned perpendicular relative to the side guards 12. A plurality of projections 46 may be coupled to each of the guards 12, 24 and extend outwardly from an outer edge 48 of each of the guards 12, 24. Each of the projections 46 is preferably arcuate. Each of the projections 46 has a top edge. The top edge of each projection 46 is spaced relative to the top edge of an adjacently positioned projection 46.

A slot 50 is positioned in each of the side guards 12 and the front guard 24 wherein the slot 50 of each of the side guards 12 is positioned in a respective outer panel 14 and the slot 50 of the front guard 24 is positioned in the outside panel 26. Each of the slots 50 has a plurality of teeth 52 preferably positioned centrally therein such that each of the slots 50 is configured to receive corresponding teeth 54 from a hair clipper 56. The teeth 52 of the slots 50 may extend longitudinally from a first side 58 to a second side 60 of each of the slots 50. The outer panel 14 is slidable relative to the inner panel 16 of each of the side guards 12 and the outside panel 26 is slidable relative to the inside panel 28 of the front guard 24 such that hair 62 positioned on an inner side 64 of a respective one of the guards 12, 24 is cut when a respective one of the panels 14, 26 is moved along a length of the guard 12, 24 and the hair 62 is engaged by the teeth 54 of the clipper 56. Indicia 66 may be positioned on each of the guards 12, 24. The indicia 66 are preferably positioned on an outer face 68 of each of the outside panel 26 and the outer panels 14 such that the indicia 66 are exposed and configured to facilitate accurate trimming of the hair 62 of the wearer. The indicia 66 preferably show measurements in centimeters along the length of the guards 12, 24, though other measurements, such as inches, may be used as well.

A pair of adjustment fasteners 70 may be positioned on each of the guards 12, 24. The adjustment fasteners 70 of the side guards 12 preferably extend around the outer panel 14 and the inner panel 16. The adjustment fasteners 70 of the front guard 24 preferably extend around the outside panel 26 and the inside panel 28. Each of the adjustment fasteners 70 may be telescopic and each have a respective channel 72 positioned therein such that increasing a distance between one of the pairs of adjustment fasteners 70 increases a length of a respective one of the guards 12, 24 by sliding one of the outer panel 14 and the outside panel 26 outwardly of the respective channel 72 and decreasing a distance between a pair of adjustment fasteners decreases a length of a respective one of the guards by sliding one of the outer panel 14 and the outside panel 26 inwardly into the respective channel 72. In this manner, the length of the guards 12, 24 may be adjusted to fit a variety of sizing needs.

In use, as stated above and shown in the Figures, the device 10 is placed against a person's head 32 such that the front guard 24 is positioned against the wearer's forehead 36 or back of the neck 34, and the side guards 12 are positioned against the sides 30 of the wearer's head 32. The adjustment fasteners 70 are slid into or out of channel 72 as desired to either decrease or increase, respectively, a length of the front guard 24 or the side guards 12. Teeth 54 from the hair clipper 56 are aligned with teeth 52 of the slots 50, and the clipper 56 is then moved along a length of the guards 12, 24 in order to cut the wearer's hair 62 and create a well-defined edge. Indicia 66 on the guards 12, 24 provide measurements to help ensure accurate cutting.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A guided hair-cutting device comprising:

a pair of side guards, each of said side guards comprising an outer panel abutting an inner panel;

a front guard coupled to and extending between said side guards, said front guard comprising an outside panel abutting an inside panel, said side guards extending downwardly away from said front guard wherein said side guards are configured for positioning against sides of a head of a wearer and said front guard is configured for positioning against a back of a neck or a forehead of the wearer; and a slot positioned in each of said side guards and said front guard wherein said slot of each of said side guards is positioned in a respective said outer panel and said slot of said front guard is positioned in said outside panel, each of said slots having a plurality of teeth positioned therein such that each of said slots are configured to receive corresponding teeth from a hair clipper, said outer panel being slidable relative to said inner panel of each of said side guards and said outside panel being slidable relative to said inside panel of said front guard such that hair positioned on an inner side of a respective one of said guards is cut when a respective one of said panels is moved along a length of said guard and the hair is selectively engaged by the teeth of the hair clipper.

2. The device of claim 1, further comprising said side guards comprising a top portion, a bottom portion, and a medial portion extending between said top and bottom portions, said top portion being spaced and parallel relative to said bottom portion, said medial portion being offset from said top and bottom portions.

3. The device of claim 2, further comprising an upper inner edge of said top portion of each of said side guards being coupled to a bottom outside edge of a respective one of a first side and a second side of said front guard.

4. The device of claim 1, further comprising said side guards being parallel, said side guards being positioned perpendicular relative to said front guard.

5. The device of claim 1, further comprising said front guard being arcuate.

6. The device of claim 1, further comprising a plurality of projections coupled to each of said guards, said projections extending outwardly from an outer edge of each of said guards, each of said projections being arcuate, each of said projections having a top edge, said top edge of each said projection being spaced relative to said top edge of an adjacently positioned said projection.

7. The device of claim 1, further comprising said teeth of said slots extending longitudinally from a first side to a second side of each of said slots.

8. The device of claim 1, further comprising indicia being positioned on each of said guards, said indicia being positioned on an outer face of each of said outside panel and said outer panels such that said indicia is exposed and configured to facilitate accurate trimming of the hair of the wearer.

9. The device of claim 1, further comprising a pair of adjustment fasteners being positioned on each of said guards, said adjustment fasteners of said side guards extending around said outer panel and said inner panel, said adjustment fasteners of said front guard extending around said outside panel and said inside panel.

10. The device of claim 9, further comprising said adjustment fasteners being telescopic and each having a respective channel positioned therein such that increasing a distance between one of said pairs of adjustment fasteners increases a length of a respective one of said guards by sliding one of said outer panel and said outside panel outwardly of said respective channel and decreasing a distance between a pair of adjustment fasteners decreases a length of a respective one of said guards by sliding one of said outer panel and said outside panel inwardly into said respective channel.

11. A guided hair-cutting device comprising:

a pair of side guards, each of said side guards comprising an outer panel abutting an inner panel, said side guards being spaced and parallel, said side guards comprising a top portion, a bottom portion, and a medial portion extending between said top and bottom portions, said top portion being spaced and parallel relative to said bottom portion, said medial portion being offset from said top and bottom portions;

a front guard coupled to and extending between said side guards, said front guard comprising an outside panel abutting an inside panel, said front guard being arcuate, said side guards extending downwardly away from said front guard wherein said side guards are configured for positioning against sides of a head of a wearer and said front guard is configured for positioning against a back of a neck or a forehead of the wearer, an upper inner edge of said top portion of each of said side guards being coupled to a bottom outside edge of a respective one of a first side and a second side of said front guard, said front guard being positioned perpendicular relative to said side guards;

a plurality of projections coupled to each of said guards, said projections extending outwardly from an outer edge of each of said guards, each of said projections being arcuate, each of said projections having a top edge, said top edge of each said projection being spaced relative to said top edge of an adjacently positioned said projection;

a slot positioned in each of said side guards and said front guard wherein said slot of each of said side guards is positioned in a respective said outer panel and said slot of said front guard is positioned in said outside panel, each of said slots having a plurality of teeth centrally positioned therein such that each of said slots are configured to receive corresponding teeth from a hair clipper, said teeth of said slots extending longitudinally from a first side to a second side of each of said slots, said outer panel being slidable relative to said inner panel of each of said side guards and said outside panel being slidable relative to said inside panel of said front guard such that hair positioned on an inner side of a respective one of said guards is cut when a respective one of said panels is moved along a length of said guard and the hair is selectively engaged by the teeth of the hair clipper;

indicia being positioned on each of said guards, said indicia being positioned on an outer face of each of said outside panel and said outer panels such that said indicia is exposed and configured to facilitate accurate trimming of the hair of the wearer; and a pair of adjustment fasteners being positioned on each of said guards, said adjustment fasteners of said side guards extending around said outer panel and said inner panel, said adjustment fasteners of said front guard extending around said outside panel and said inside panel, said adjustment fasteners being telescopic and each having a respective channel positioned therein such that increasing a distance between one of said pairs of adjustment fasteners increases a length of a respective one of said guards by sliding one of said outer panel and said outside panel outwardly of said respective channel and decreasing a distance between a pair of adjustment fasteners decreases a length of a respective one of said guards by sliding one of said outer panel and said outside panel inwardly into said respective channel.

* * * * *